United States Patent [19]

Woolsey

[11] Patent Number: 5,038,498

[45] Date of Patent: Aug. 13, 1991

[54] BULK MATERIAL DRYER

[76] Inventor: Rick Woolsey, 1939 Sheridan Bridge La., Olathe, Kans. 66062

[21] Appl. No.: 532,851

[22] Filed: Jun. 4, 1990

[51] Int. Cl.[5] ..... F26B 19/00; F26B 25/06

[52] U.S. Cl. ..... 34/225; 34/203; 34/208; 34/219; 34/224

[58] Field of Search ..... 34/228, 225, 224, 189, 34/190, 208, 219, 236, 203

[56] References Cited

U.S. PATENT DOCUMENTS

| | | | |
|---|---|---|---|
| 2,365,769 | 12/1944 | Marshall | 34/225 |
| 2,418,683 | 4/1947 | Wilson | 34/219 X |
| 2,952,452 | 9/1960 | Kopf . | |
| 3,352,025 | 11/1967 | Brock | 34/219 |
| 3,526,483 | 9/1970 | Deussner et al. . | |
| 3,749,382 | 7/1973 | Thompson . | |
| 3,800,429 | 4/1974 | Lindl . | |
| 3,893,244 | 7/1975 | Danford | 34/225 |
| 4,572,726 | 2/1986 | Van Abbems . | |
| 4,706,390 | 11/1987 | Kitchen . | |

OTHER PUBLICATIONS

Wenger Model 4800 Dryer for Extruded Snacks and Breakfast Cereals.
Wenger Series II Single and Double Press Dryers.
Aeroglide Process/Driers/Coolers.
Manley Baking & Drying Ovens.
B.N.W. Industries Belt-O-Matic Multi-Purpose Horizontal Dryer.
Proctor Single Conveyor Dryer.
Proctor Multiple Conveyor Dryer.

*Primary Examiner*—Edward G. Favors
*Attorney, Agent, or Firm*—Kokjer, Kircher, Bradley, Wharton, Bowman & Johnson

[57] ABSTRACT

A bulk material dryer includes a cabinet with material inlet and outlet openings and air inlet and outlet openings. A conveying system is located in the cabinet for conveying the bulk material therethrough from the material inlet opening to the material outlet opening. An air handling system includes a supply duct subsystem communicating with the air inlet and a return duct subsystem communicating with the air outlet. A blower provides an airstream through the supply duct subsystem and draws air from the return duct subsystem for recirculation through a separator and a heater.

19 Claims, 2 Drawing Sheets

BULK MATERIAL DRYER

BACKGROUND OF THE INVENTION

1. Field of the Invention

The present invention relates generally to bulk material processing and in particular to a bulk material dryer.

2. Description of the Related Art

Various types of bulk materials are processed in continuous, as opposed to batch, operations. A common such continuous operation involves the removal of moisture from the material being processed. For example, numerous materials, including food and feed, have relatively high moisture contents during certain stages of processing. Such moisture may be present in the raw materials, or it may be added during processing. For example, extruders can be used to cook and form materials with relatively high moisture contents, and dryers are sometimes used in sequence with extruders to remove excess moisture from the extruded products.

A previous type of bulk material dryer includes a cabinet with one or more conveyor passes or runs extending therethrough and ductwork for supplying and receiving heated air located alongside the cabinet. Heated air can be introduced by means of a blower to a lower portion of the cabinet interior for passing upwardly through the material-laden conveyor belts. The heated air can then be collected at the cabinet top and returned to the cabinet side with the air handling equipment. Although heated air can be recirculated with such an arrangement for energy efficiency, certain disadvantages can be encountered. Static air pressure and airflow velocity tend to decrease with distance from the air supply inlets along one side of the cabinet, resulting in uneven airflow and drying. The heated air can bypass much of the material within the dryer cabinet and instead take the shortest route to return air outlets located in the side of the dryer cabinet with the air handling equipment. Uneven product drying and inefficient energy usage can result.

Another problem with some previous dryers is that they occasionally caught fire when particles (e.g. dust and fines) were ignited by the heaters. Various bulk materials, including grain-based food and feed products, can produce flammable dust and fines. The burners and other heat sources of some previous dryers have ignited such combustible particles, and internal dryer fires can cause extensive damage.

Locating the air handling system alongside the dryer in previous dryer designs also tended to increase the floor area requirements thereof, which can be a serious disadvantage in processing facilities with limited floor area.

Previous dryers have had other configurations and air handling system placements; however, heretofore there has not been available a bulk material dryer with the advantages and features of the present invention. The present invention addresses these deficiencies with previous bulk material dryers.

SUMMARY OF THE INVENTION

In the practice of the present invention, a bulk material dryer is provided which includes a cabinet with material inlet and outlet openings and air inlet and outlet openings. A conveying system conveys bulk material through the cabinet from the material inlet opening to the material outlet opening and includes four individual endless-belt conveyors which convey the material along four passes (two in each direction) through the cabinet. The conveyor belts have open or porous constructions which permit passage of drying air therethrough. An air handling system includes a supply duct connected to the air inlet openings in the cabinet and a return duct connected to the air outlet openings. Return air from the return duct enters a cyclone-type separator for removing fines and particles from the return airstream and a blower or fan recirculates the cleaned air through a heater and the supply air duct. The air inlets are positioned in offset pairs on opposite sides of the cabinet for creating a swirling airflow within lower portions of the cabinet.

OBJECTS AND ADVANTAGES OF THE PREFERRED EMBODIMENT

The objects and advantages of the present invention include: providing a dryer for bulk material; providing such a dryer which can be adapted to dry a variety of bulk materials; providing such a dryer which requires relatively little floor area; providing such a dryer which cleans recirculated air prior to reheating for reduced fire risks; providing such a dryer with a swirling, airflow pattern; providing such a dryer with relatively uniform airflow characteristics in desired areas of a dryer cabinet thereof; providing such a dryer which tends to apply hotter air to hotter, dryer material; providing such a dryer which includes multiple conveyor runs stacked vertically; providing such a dryer which can be provided in various lengths; providing such a dryer which can be lengthened or shortened by adding or removing sections; providing such a dryer which can be adapted for relatively high throughput; providing such a dryer which is adaptable for use with various heater means; providing such a dryer which is efficient in operation, economical to manufacture, capable of a long operating life, and particularly well adapted for the proposed usage thereof. Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
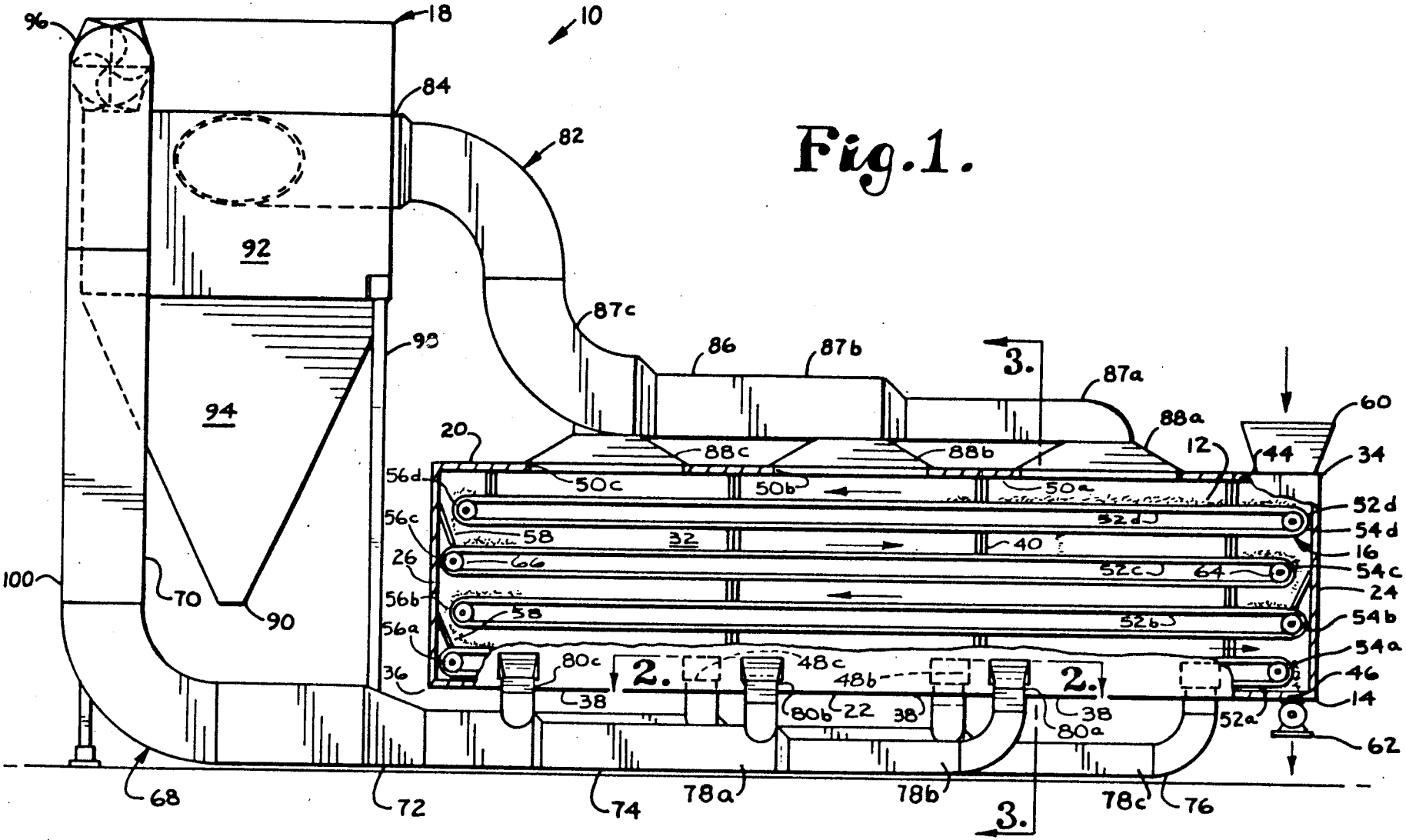
FIG. 1 is a side elevational view of a bulk material dryer embodying the present invention, with portions broken away to reveal internal construction.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of similar import.

Referring to the drawings in more detail, the reference numeral 10 generally designates a dryer for bulk material 12. Without limitation on the generality of useful applications of the dryer 10, the bulk material 12 can comprise food or feed products, including snack food, breakfast cereals and dry pet food. The bulk material 12 can also comprise various non-food materials. The dryer 10 generally comprises a cabinet 14, a conveying system 16 and an air handling system 18.

II. Cabinet 14

The cabinet 14 includes a top panel 20, a bottom panel 22, first and second opposite side panels 24, 26 and first and second opposite end panels 28, 30. The panels enclose a cabinet interior 32. The cabinet 14 can be fabricated in sections, e.g. first and second end sections 34, 36 and intermediate sections 38a, b and c. The sections are suitably interconnected at seams 40 which extend across respective panels 20, 22, 24 and 26. Dryers according to the present invention can be assembled in various lengths by connecting appropriate numbers of such sections, and can be shortened and lengthened by removing and adding intermediate cabinet sections 38.

Inlet and outlet openings 44, 46 for the material 12 are located in the top and bottom panels 20, 22 respectively in proximity to the first end panel 28. Three air inlet openings 48*a*, 48*b*, 48*c*, are provided in each side panel 24, 26 adjacent to lower edges thereof, and each communicates with the cabinet interior 32. Corresponding pairs of air inlet openings 48*a–c* are staggered longitudinally with respect to each other. Air outlet openings 50*a*, 50*b*, 50*c* are formed in the top panel 20; three in longitudinal alignment are shown over the cabinet interior 32. The cabinet 14 can be supported on a suitable structural framework (not shown). The cabinet interior 32 is enclosed by the panels and is accessed through the various openings.

III. Conveying System 16

The conveying system 16 comprises four endless-belt conveyors 52*a*, 52*b*, 52*c*, 52*d* stacked vertically within the cabinet 14 and each including first and second ends 54*a–d*, 56*a–d*, located adjacent to the cabinet first and second end panels 28, 30 respectively. Each conveyor first end 54*a–d* is reeved over a respective first roller assembly 64*a–d*, and each conveyor second end 56*a–d* is reeved over a respective second roller assembly 66*a–d*. One of the roller assemblies for each conveyor 52*a–d* can be driven and the other configured for idling. The conveyors 52*a–d* are staggered with respect to each other in an alternating sequence whereby the conveyor first ends 54*b* and 54*d* are located closer to the first end panel 28 than the conveyor first ends 54*a* and 54*c*, and the conveyor second ends 56*a* and 56*c* are located closer to the second end panel 30 than the conveyor second ends 56*b* and 56*d*. Thus, the conveyor ends 54*b*, *d* and 56*a*, *c* are receiving ends, and the conveyor ends 54*a*, *c* and 56*b*, *d* are discharge ends. Deflector strips or shields 58 extend transversely between the side panels 24, 26 and each extends downwardly and inwardly from a respective end panel 28, 30 to a respective conveyor receiving end 54*b*, *d* and 56*a*, *c* to guide bulk material 12 thereonto from respective conveyor discharge ends 54*a*, *c* and 56*b*, *d*.

An inlet hopper 60 extends upwardly from the inlet material opening 44 and is adapted to deposit bulk material 12 on the conveyor receiving end 54*d*. Various types of material input or supply equipment can be associated with the inlet material opening 44. For example, vibrating product spreaders can be utilized. A rotary valve 62 depends downwardly from the outlet material opening 46 and receives material from the conveyor discharge end 54*a* for discharge from the cabinet 14.

The conveyors can be driven by four independent, variable speed motors. Alternatively, a pair of motors can be provided for driving the conveyors which travel in the same directions; i.e. conveyors 52*a*, *c* being driven by one motor and conveyors 52*b*, *d* being driven by the other motor. A single drive motor drivingly connected to all of the driven roller assemblies through a suitable power transmission arrangement could also be provided. The conveyor drive motors can be controlled by individual speed controls, or by a master speed control. Suitable conveyor speed synchronization equipment can be provided. The conveyors 52 can be driven by the motors by means of suitable power transmission devices, such as chain-and- sprocket belt-and-pulley, gears, etc.

The conveyors 52*a–d* can comprise multiple, transverse slats linked together to form endless belts. Such conveyor belts are sometimes used for this general type of dryer and include openings or passages for permitting airflow therethrough. The conveyors 52*a–d* include side edges 57 which can be slidably supported on respective angle- section rails 55 which extend longitudinally through the cabinet interior 32 along the inside faces of the side panels 24, 26 and are configured in opposed pairs.

III. Air Handling System 18

The air handling system 18 includes a supply duct subsystem 68 including a supply trunk 70, which forks at a Y connection 72 to first and second supply manifold,s 74, 76, each including three supply branches 78*a*, 78*b*, 78*c* which terminate at inlet elbows 80*a*, 80*b*, 80*c* which respectively open into the air inlet openings 48*a*, 48*b*, 48*c*.

A return duct subsystem 82 includes a return trunk 84 and a return manifold 86 connected by return branches 87*a*, 87*b*, 87*c* to three exhaust or return hoods 88*a*, 88*b*, 88*c*communicating with air outlet openings 50*a*, 50*b*, 50*c* respectively.

A cyclone-type separator 90 includes an upper chamber 92 with a generally cylindrical configuration and a lower chamber 94 with a generally frusto-conical or funnel-shaped configuration. The supply and return trunks 70, 84 communicate with the cyclone separator upper chamber 92, the supply trunk 70 extending substantially tangentially to the separator upper chamber 92 and including a blower or fan 96. The cyclone separator 90 can be supported on a suitable support stand structure 98.

A ring burner 100 is provided in the supply trunk 70 and can utilize any suitable power source. Various other suitable heater arrangements can be utilized for heating and reheating the supply airstream, e.g. a heat exchanger.

The supply and return duct subsystems 68, 82 can include circular, cross-sectional configurations for greater efficiency and lower noise levels in operation from airflow and mechanical vibrations as compared to ducting with rectangular, cross-sectional configurations.

IV. Operation

The dryer 10 operates to efficiently dry the bulk material 12 by providing relatively uniform and energy-efficient drying with reduced fire risk in a relatively compact configuration.

Material 12 enters the dryer 10 through the inlet hopper 60 (or other suitable input device) and is deposited on the conveyor receiving end 54*d*. As viewed in FIG. 1, the bulk material 12 is then conveyed from right-to-left by conveyor 52*d*, from left-to-right by conveyor 54*c*, from right-to-left by conveyor 52*b*, and from left-to-right by conveyor 52*a* for discharge through the rotary valve 62.

Figure 3:
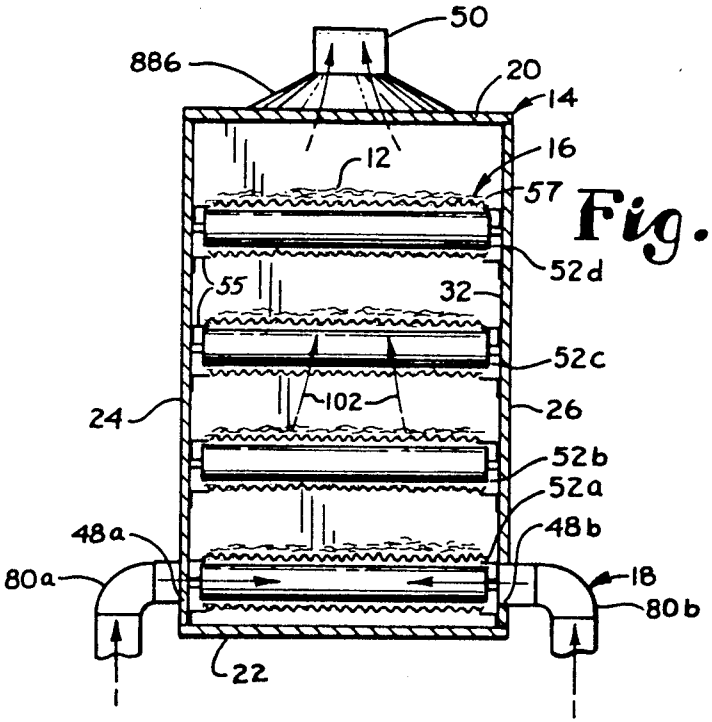
FIG. 3 is an enlarged, vertical, cross-sectional view of the dryer taken generally along line 3—3 in FIG. 1.
Figure 2:
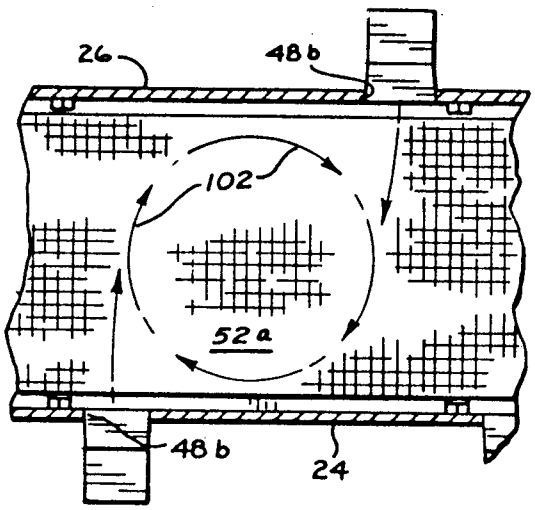
FIG. 2 is an enlarged, fragmentary, horizontal cross-sectional view of the dryer taken generally along line 2—2 in FIG. 1.
Figure 4:
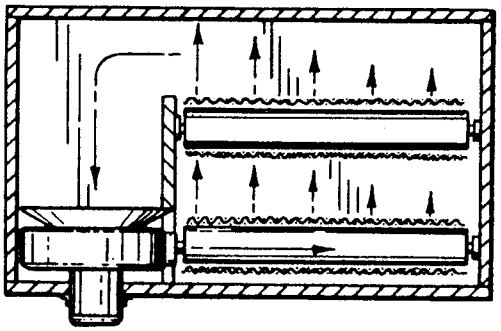
Fig. 4. PRIOR ART
FIG. 4 is a vertical, transverse, cross-sectional view of a dryer with a figuration similar to a type of prior art dryer.

The heated/reheated supply airstream enters the cabinet 14 through the inlet openings 48*a–c* between the runs of the lowermost conveyor 52*a*. The offset, staggered locations of the paired inlet openings 48*a–c* create a swirling vortex- type airflow pattern in a lower portion of the cabinet interior 32 (FIG. 2). Contact between the airstream and the material 12 on the lowermost conveyor 52*a* is facilitated by this swirling airflow pattern. After the airstream leaves the lowermost conveyor 52*a* and the material 12 thereon, the airstream flow direction is generally more in a upward direction, as indicated by the airstream arrows 102 in FIG. 3.

The thermodynamic operation of the dryer 10 also enhances efficiency. The heated, supply air is generally hottest in the lower portions of the cabinet interior 32, and specifically between the runs of the lowermost conveyor 52*a*. In this location the bulk material 12 is dryest and warmest and thus requires relatively hot air to remove additional moisture. By contrast, the uppermost conveyor 52*d* has the wettest and coolest material 12, from which moisture is more easily removed with less heat. Thus, the operating parameters or variable characteristics of the airflow and the material 12 can generally be as follows: (1) air velocity decreases as the airflow progresses upwardly through the cabinet 14; (2) air pressure decreases upwardly through the cabinet 14; (3) air temperature decreases upwardly through the cabinet 14; (4) material temperature increases downwardly through the cabinet 14; and (5) material moisture content decreases downwardly through the cabinet 14.

The exhaust air is collected in the return hoods 88*a–c* for cleaning in the cyclone separator 90 wherein fines and other particles tend to fall out of a swirling vortex into the cyclone separator lower chamber 94 for removal. Relatively clean, preheated air is pulled through the cyclone separator upper chamber 92 by the fan 96 for discharge to the supply trunk 70 and the ring burner 100 for heating and recirculation to the dryer cabinet 14. Various types of filters can be placed in different locations in the air handling system 18 to further clean the recirculated air. The rotary outlet valve 62 limits air escaping from the cabinet 14 so that the airflow is primarily directed upwardly.

The dryer 10 is relatively compact in plan since its air handling system 18 is primarily positioned above, below, and spaced from the cabinet 14. The cyclone separator 90 can be located at various positions remote from the cabinet 14, e.g. outside of a building in which the rest of the dryer 10 is located.

It is to be understood that while certain forms of the present invention have been illustrated and described herein, it is not to be limited to the specific forms or arrangement of parts described and shown.

What is claimed and desired to be secured by Letters Patent is as follows:

1. A bulk material dryer, which includes:
(a) a cabinet including:
(1) a top panel;
(2) a bottom panel;
(3) opposite side panels;
(4) opposite end panels; and
(5) a cabinet interior;
(b) a product inlet through said cabinet and into the interior thereof;
(c) a product outlet through said cabinet from said cabinet interior;
(d) foraminous belt conveyor means extending longitudinally through said cabinet and including a first end for receiving product from said inlet and a second end for discharging product to said product outlet;
(e) a pair of air inlet openings through said cabinet, said air inlet openings transversely staggered with respect to each other; and
(f) blower means connected to said air inlet openings for supplying air to said cabinet interior, whereby air from said blower means enters said cabinet simultaneously through said pair of staggered air inlet openings to create a swirling vortex airflow pattern within the lower portion of said cabinet.

2. The invention of claim 1, which includes multiple, opposed, staggered pairs of said air inlet openings in the sides of said cabinet to create a plurality of swirling vortex airflow patterns within the lower portion of said cabinet.

3. A bulk material dryer, which includes:
(a) a cabinet including:
(1) a top panel;
(2) a bottom panel;
(3) opposite side panels;
(4) opposite end panels;
(5) a cabinet interior; and
(6) multiple, opposed, staggered pairs of air inlet openings in the sides of said cabinet, each said pair of air inlet openings transversely staggered with respect to each other;
(b) a product inlet through said cabinet and into the interior thereof;
(c) a product outlet through said cabinet from said cabinet interior;
(d) conveyor means extending longitudinally through said cabinet and including a first end for receiving product from said inlet and a second end for discharging product to said product outlet; and (e) blower means connected to said air inlet openings for supplying air to said cabinet interior;

wherein said conveyor means comprises an endless belt conveyor with upper and lower runs; and said air inlet openings are located on a level between said conveyor runs.

4. The invention of claim 1, wherein:

(a) said conveyor means comprises multiple, longitudinally-extending, endless belt conveyors.

5. The invention of claim 4 wherein:

(a) said cabinet has first and second ends;

(b) each said conveyor has first and second ends respectively positioned in proximity to said cabinet first and second ends; and (c) said conveyors have alternating, reverse directions of travel.

6. The invention of claim 4, which includes:

(a) a plurality of shields each associated with a respective conveyor receiving end for directing material thereonto.

7. The invention of claim 1, which includes:

(a) heater means for heating the air blown through said cabinet interior.

8. The invention of claim 1, which includes:

(a) air recirculation means for recirculating air from and to said cabinet interior.

9. The invention of claim 8, which includes:

(a) filter means associated with said air recirculation means.

10. A bulk material dryer, which includes:

(a) a cabinet including:

(1) a top panel;

(2) a bottom panel;

(3) opposite side panels;

(4) opposite end panels; and (5) a cabinet interior;

(b) a product inlet through said cabinet and into the interior thereof;

(c) a product outlet through said cabinet from said cabinet interior;

(d) conveyor means extending longitudinally through said cabinet and including a first end for receiving product from said inlet and a second end for discharging product to said product outlet;

(e) blower means for blowing air through said cabinet interior;

(f) air recirculation means for recirculating air from and to said cabinet interior; and (g) filter means associated with said air recirculation means, said filter means comprising a cyclone-type separator.

11. A bulk material dryer, which includes:

(a) a cabinet including:

(1) a top panel;

(2) a bottom panel;

(3) opposite first and second side panels;

(4) opposite first and second end panels; and (5) a cabinet interior;

(b) product inlet and outlet openings through said cabinet to the interior thereof;

(c) air inlet and outlet openings through said cabinet to the interior thereof;

(d) a conveyor system extending longitudinally through said cabinet and including a first end for receiving product from said inlet opening and a second end for discharging product to said product outlet opening; and (e) an air handling system including:

(1) a supply air subsystem communicating with said air inlet opening;

(2) a return air subsystem communication with said air outlet opening;

(3) an air blower pneumatically connected to said supply and return air subsystems;

(4) airstream heater means; and (5) particle separator means communicating with said supply and return duct subsystems, wherein said air blower being positioned downstream from said separator upstream from said air inlet opening.

12. The invention of claim 11 wherein:

(a) said cabinet includes a plurality of sections connected together in longitudinal alignment.

13. The invention of claim 11 wherein:

(a) said heater means comprises a ring burner associated with said air supply duct subsystem.

14. The invention of claim 11 wherein:

(a) said heater means comprises a heat exchanger associated with said air supply duct subsystem.

15. The invention of claim 11 wherein:

(a) said cabinet includes a pair of air inlet openings transversely staggered with respect to each other and communicating with said blower means.

16. The invention of claim 15, which includes multiple, opposed, staggered pairs of said air inlet openings in the sides of said cabinet.

17. The invention of claim 16 wherein:

(a) said conveyor system comprises an endless belt conveyor with upper and lower runs;

(b) said air inlet openings are located on a level between said conveyor runs; and (c) said conveyor includes multiple air passages therethrough.

18. A bulk material dryer, which includes:

(a) a cabinet including:

(1) a top panel;

(2) a bottom panel;

(3) first and second opposite side panels;

(4) first and second opposite end panels; and (5) a cabinet interior;

(b) a product inlet through said cabinet and into the interior thereof;

(c) a product outlet through said cabinet from said cabinet interior;

(d) a conveyor system including:

(1) a first conveyor positioned above said cabinet bottom panel;

(2) a second conveyor positioned above said first conveyor;

(3) a third conveyor positioned above said second conveyor; and (4) a fourth conveyor positioned above said third conveyor;

(e) each said conveyor having an endless belt configuration and air passage means extending therethrough;

(f) each said conveyor including a material receiving end and a material discharge end:

(1) said first, second and third conveyor receiving ends being positioned respectively under said second, third and fourth conveyor discharge ends;

(2) said first conveyor discharge end being positioned over said material outlet opening; and (3) said fourth conveyor receiving end being positioned under said material inlet opening;

(g) a plurality of roller assemblies extending transversely between said cabinet sides and each including a transverse rotational axis, each said roller assembly having a respective conveyor end reeved thereover;

(h) drive means drivingly connected to one of the roller assemblies associated with each said conveyor;

(i) a plurality of product shields each mounted on and extending inwardly and downwardly from a respective cabinet end panel towards a respective conveyor receiving end; and (j) an air handling system including:

(1) a supply air system including:

(i) a supply air trunk;

(ii) a supply air manifold communicating with the supply air trunk;

(iii) a plurality of supply air branches communicating with the supply air manifold; and (iv) a plurality of supply air elbows each pneumatically communicating a respective supply air branch with a respective air inlet opening;

(2) a return air system including:

(i) a return air trunk;

(ii) a return air manifold communicating with the return air trunk;

(iii) a plurality of return air branches communicating with the return air manifold; and (iv) a plurality of exhaust hoods each communicating a respective return air branch with a respective air outlet opening;

(3) a cyclone-type separator with an inlet pneumatically connected to the return air trunk and an outlet; and (4) an air blower pneumatically connected to the separator outlet and to the supply air trunk.

19. A bulk material dryer housing for a material drying system, said housing comprising:

(a) a cabinet including:

(1) a top panel;

(2) a bottom panel;

(3) opposite side panels;

(4) opposite end panels; and (5) a housing interior;

(b) a product inlet through said cabinet and into the interior thereof;

(c) a product outlet through said cabinet from said cabinet interior;

(d) a continuous, foraminous belt conveyer means having upper and lower runs, said conveyor means extending longitudinally through said cabinet for conveying product on said upper run within said cabinet; and (e) a pair of air inlet openings disposed through said cabinet between said upper and lower runs of said conveyor means, said air inlet openings transversely staggered with respect to each other.

* * * * *